US005513564A

United States Patent [19]

Sato

[11] Patent Number: 5,513,564

[45] Date of Patent: May 7, 1996

[54] STENCIL DUPLICATING MACHINE

[75] Inventor: Mitsuo Sato, Shibata, Japan

[73] Assignee: Tohoku Ricoh Co., Ltd., Miyagi, Japan

[21] Appl. No.: 183,300

[22] Filed: Jan. 19, 1994

[30] Foreign Application Priority Data

Jan. 19, 1993 [JP] Japan ..... 5-006781
Nov. 4, 1993 [JP] Japan ..... 5-275690

[51] Int. Cl.[6] ..... B41L 13/04; B41C 1/14

[52] U.S. Cl. ..... 101/116; 101/128.4

[58] Field of Search ..... 101/114, 116, 101/117, 118, 128.21, 128.4, 477, 128.1

[56] References Cited

FOREIGN PATENT DOCUMENTS

| | | | |
|---|---|---|---|
| 0011284 | 1/1986 | Japan | 101/114 |
| 62-73987 | 4/1987 | Japan . | |
| 0073988 | 4/1987 | Japan | 101/116 |
| 0239581 | 10/1991 | Japan | 101/116 |
| 0270974 | 12/1991 | Japan | 101/116 |
| 2250481 | 6/1992 | United Kingdom | 101/114 |

*Primary Examiner*—Christopher A. Bennett
*Attorney, Agent, or Firm*—Oblon, Spivak, McClelland, Maier, & Neustadt

[57] ABSTRACT

A stencil duplicating machine comprises a rotary cylindrical drum, an ink supply disposed inside the rotary cylindrical drum, a stencil supply unit, a stencil take-up unit, and a stencil making section. The rotary cylindrical drum is adapted to support a stencil on an outer circumferential surface thereof and is rotatable with the stencil. During the printing process, the rotary cylindrical drum, stencil supply unit and stencil take-up unit rotate together.

18 Claims, 13 Drawing Sheets

STENCIL DUPLICATING MACHINE

FIELD OF THE INVENTION

This invention relates to a stencil duplicating machine of the type having a stencil making section and a printing section in an integrated assembly. The stencil making section perforates a pattern of an original image on a stencil by a thermal perforation process.

DESCRIPTION OF RELATED ART

In a conventional stencil duplicating machine including a stencil making section, a pattern corresponding to an original image is perforated on a stencil by a thermal and digital perforation process. In such a process, the stencil is paid out from a stencil web, and is pressed to a thermal head on a platen roller to have a pattern of the original image perforated thereon. Then, the perforated stencil (called "stencil" hereinafter) is wound around the outer circumferential surface of a rotary cylindrical drum (called "printing drum" hereinafter) with its leading edge gripped by a clamp on the printing drum, and is cut to a predetermined length. After printing, a used stencil is peeled off from the printing drum with either the leading or trailing edge thereof caught by a peeling claw or a discharging roller, and is finally dumped into a used stencil box. In other words, the stencil is cut to the predetermined length from the stencil web each time a new stencil is perforated with a patterns indicative of each original image. Then, each used stencil is discharged.

Japanese Patent Laid-open Publication No. Sho 62-73987 proposes a stencil duplicating machine, which uses a non-cut stencil. In this machine, a printing drum rotates integrally with a stencil web, a stencil making section and a stencil take-up section disposed thereon.

The first-mentioned stencil duplicating machine needs a stencil cutter. Such a stencil cutter is rather expensive. While it is being fed to the printing drum, the cut stencil tends to be prone to problems such as jamming and unreliable gripping by the clamp. Sometimes, the stencil is skewed or wrinkled on the printing drum. Further, the stencil after use may not be properly peeled off from the printing drum and may be jammed while being conveyed to a discharging section. When it is made substantially of only a very thin thermo-plastic resin film to assure high-quality printing, the stencil is often subject to jamming and unreliable gripping by the clamp as described above.

The second-mentioned stencil duplicating machine has been proposed to overcome these problems, but also suffers from the following problems. During the printing process, the printing drum has to rotate under large inertia together with the stencil supply section, stencil making section including a thermal head, stencil take-up section and their associated drive means. Therefore, the stencil duplicating machine has difficulty performing a high speed printing operation, and the printing drum tends to vibrate extensively.

Since the thermal head always rotates with the printing drum as described above, signal and power lines to the thermal head and a motor for operating rollers have to be frequently connected or disconnected, which lowers the reliability of the stencil duplicating machine.

A fresh portion of the stencil is wound around the rotating printing drum at the non-apertured zone B (shown by the letter B in FIG. 19 of the accompanying drawings) as well as the apertured zone P while a used portion of the stencil is being peeled therefrom. Further, it is substantially impossible to slide, on the printing drum, the used and inked stencil sticking onto the apertured zone P of the printing drum. The stencil present on the non-apertured zone of the printing drum is not used for the printing, which results in a waste of the stencil.

Although the foregoing Japanese laid-open publication does not disclose the initial loading of a stencil web in the stencil printing machine, it appears very cumbersome to wind the stencil around the printing drum.

SUMMARY OF THE INVENTION

The present invention is directed to overcome one or more of the problems set forth above, and to provide a compact stencil duplicating machine, which comprises a stencil making section and a printing section in an integrated assembly, facilitates the use of a stencil of a thin thermo-plastic resin film, and enables only minimum and necessary units to be rotated with a printing drum so as to assure high speed printing.

According to the present invention, a stencil duplicating machine comprises: a rotary cylindrical drum including a cylinder having an apertured portion and a non-apertured portion and being adapted to support a stencil on an outer circumferential surface thereof and to be rotatable round a center shaft with the stencil supported thereon; an ink supply disposed inside the rotary cylindrical drum for supplying ink to an inner circumferential surface of the rotary cylindrical drum; a stencil supply unit for supplying the stencil to the rotary cylindrical drum, and including stencil support means for supporting a stencil web thereon and being arranged so as to be rotatable round the center shaft; a stencil take-up unit for taking up the stencil, including stencil take-up means for holding a leading portion of the stencil and peeling the stencil after use from the rotary cylindrical drum and being rotatable round the center shaft; and a stencil making section for perforating patterns of an original image on the stencil.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENT

Figure 1:
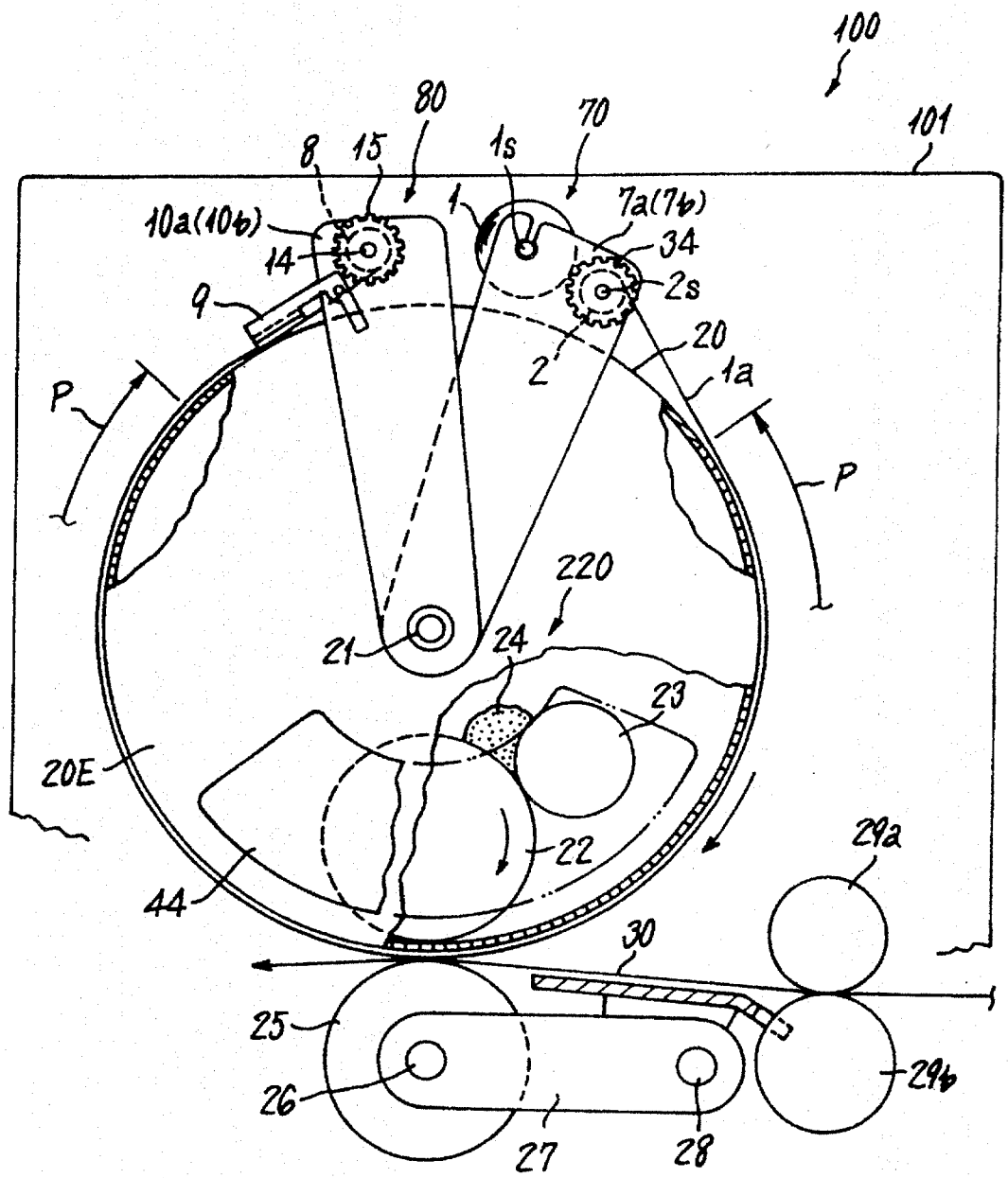
FIG. 1 is a diagrammatic view showing the main part of a stencil duplicating machine according to a preferred embodiment of the present invention.

Referring to FIG. 1, a stencil duplicating machine 100 will be described according to an embodiment of the invention. The stencil duplicating machine 100 is supported on a frame 101, and mainly comprises, a printing drum 20, an ink supply 220, a stencil supply unit 70, a stencil making unit, and a stencil take-up unit 80.

The printing drum 20 is supported about its longitudinal axis on a center shaft 21, carries a portion 1*a* of the stencil (called "stencil 1*a*") on its outer circumferential surface thereof, and is rotatable round the center shaft 21 with the stencil 1*a* wound thereon. The ink supply 220 is disposed inside the printing drum 20 and supplies ink to an inner circumferential surface of the printing drum 20. The stencil supply unit 70 feeds the stencil 1*a* to the printing drum 20 from a stencil web 1. The stencil take-up unit 80 includes a take-up spool 8 for winding thereon a used portion of the stencil which is peeled off from the outer circumferential surface of the printing drum 20. Both the stencil supply unit 70 and the stencil take-up unit 80 are arranged across the printing drum 20, and are rotatable with or independently of the printing drum 20 round the center shaft 21.

As shown in FIG. 1, the printing drum 20 is a porous cylindrical member rotatably fitted around the center shaft 21 supported by the frame 101. The printing drum 20 is rotated by a drive members (not shown) including a slip ring mechanism. The printing drum 20 has a porous area P which occupies approximately three quarters of its outer circumferential surface. This porous area P is used for the printing. The printing drum 20 also has a pair of flanges 20E at opposite ends thereof.

Each of the flanges 20E has balancing weights 44 embedded therein at a position symmetrical to the stencil supply unit 70 and the stencil take-up unit 80. The balancing weights 44 are used to assure reliable and high speed rotation of the printing drum 20, are substantially in the shape of truncated sector, and are sized to balance with the rotational moment of the stencil feeding and take-up units 70 and 80. The balancing weights 44 are arranged so as not to interfere with the rotation of the stencil supply unit 70 and the stencil take-up unit 80. For simplification, the balancing weights 44 are shown only in FIGS. 1 and 12.

Each of the flanges 20E has on the surface thereof a first dent (not shown) for receiving a first claw (not shown) of the stencil web support 7*a* (7*b*) and a second dent (not shown) for receiving a second claw (not shown) of the stencil take-up spool support 10*a* (10*b*).

The ink supply 220 includes an inking roller 22, a doctor roller 23 which is in parallel to the inking roller 22 with a fine space retained therewith, and an ink supply tube 21 (i.e. center shaft 21) for supplying ink between the inking roller 22 and the doctor roller 23. The inking roller 22 and the doctor roller 23 form an ink reservoir 24 between them.

The stencil supply unit 70 includes a pair of stencil web supports 7*a* and 7*b*, a platen roller 2, and a gear 34 for rotating the platen roller 2. The stencil web supports 7*a* and 7*b* are disposed across the printing drum 20 and positioned outside the opposite flanges 20E. The stencil web supports 7*a* and 7*b* are rotatable round the center shaft 21.

Figure 9:
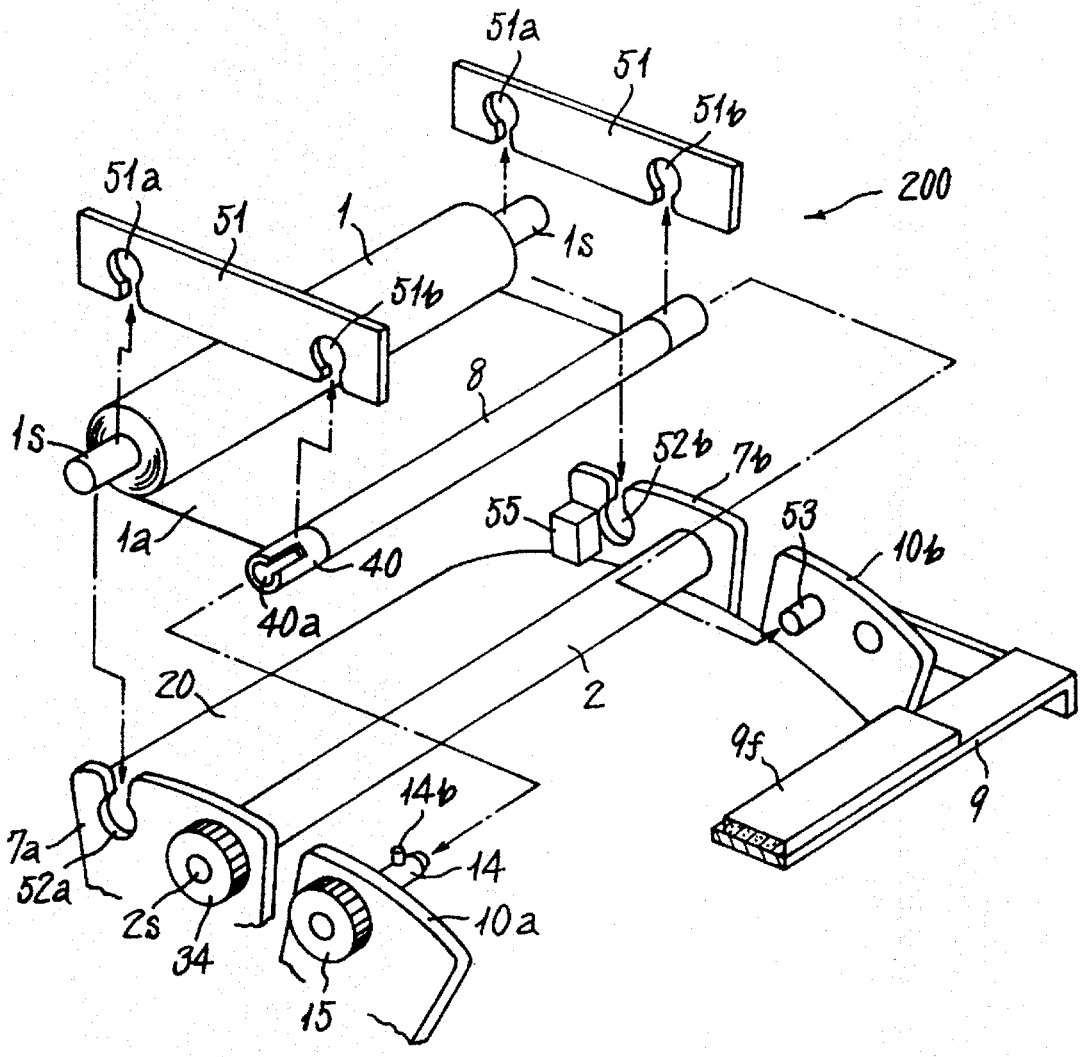
FIG. 9 is a diagrammatic perspective view showing a structure for loading or unloading the stencil web and stencil take-up means.

The stencil web supports 7*a* and 7*b* have cavities 52*a* and 52*b* in their upper parts, respectively, as shown in FIG. 9. A core 1*s* of the stencil web 1 is received in these cavities 52*a* and 52*b*, and is rotatable therein. A pair of rubber blocks 55 are attached on inner surfaces of the stencil web supports 7*a* and 7*b* near the cavities 52*a* and 52*b*, respectively, and function to brake the stencil web 1.

As shown in FIGS. 1 and 9, the platen roller 2 for passing the stencil 1*a* thereon is disposed between the stencil web supports 7*a* and 7*b* and is received therein via a rotatable shaft 2*s*, i.e. substantially integral with the shaft 2*s*. The platen roller 2 is near the stencil web 1, and is rotatable between the stencil web supports 7*a* and 7*b*.

Figure 4:
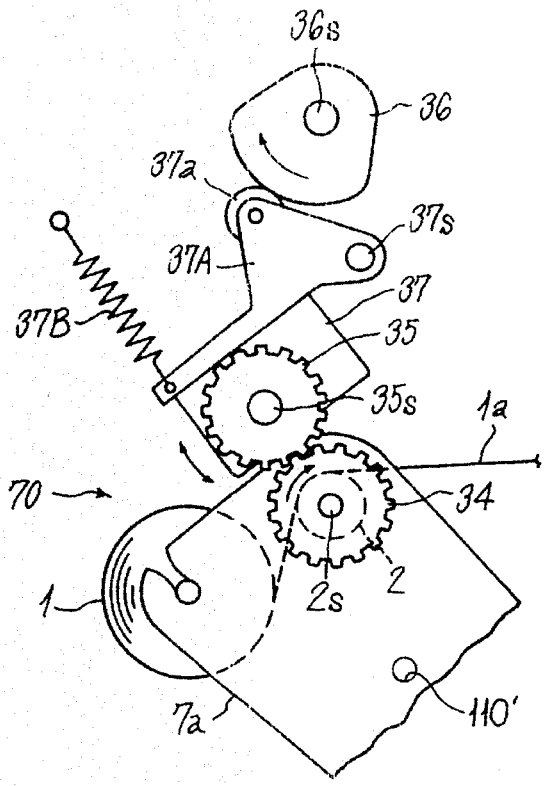
FIG. 4 is a somewhat enlarged, diagrammatic view showing the main part of a stencil supply unit and its peripheral components related to a stencil perforating process in the stencil duplicating machine of FIG. 1.

As shown in FIG. 4, the gear 34 serves as a second driven gear, and is fitted around one end of the shaft 2*s* of the platen roller 2.

A small DC motor (not shown) having a rotary shaft 36*s* is connected to an immovable member at a predetermined position of the side plate (not shown), and serves as drive means. The rotary shaft 36*s* has a cam 36 as its integral part.

The stencil 1*a*, shown in FIGS. 1 and 9, is fed from the stencil web 1 around the core 1*s*. The stencil web 1*a* is made substantially of only a thin thermo-plastic resin film, and is approximately 2 μm to 5 μm thick. The core 1*s* extends outwardly from the stencil web 1 at opposite ends thereof. Therefore, the size of the stencil web 1 is remarkably small compared with a stencil web of the prior art stencil duplicating machine. The material of the stencil is not limited to that described above but may be made of films such as a thermo-plastic resin film including a minute amount of antistatic agent, or a thermo-plastic resin film having at least one overcoating layer on one or both sides thereof.

The stencil take-up unit 80 includes a pair of stencil take-up spool supports 10*a* and 10*b*, a stencil take-up spool 8 for holding the leading portion of the stencil, peeling the used stencil and carrying the peeled stencil thereon (called "take-up spool 8"), a clamp 9 for holding the stencil 1*a*, and a gear 15. The stencil take-up spool supports 10*a* and 10*b* (called "take-up spool supports 10*a* and 10*b*") are disposed outside the flanges 20E and across the printing drum 20 similarly to the stencil web supports 7*a* and 7*b* of the stencil supply unit 70. The take-up spool supports 10*a* and 10*b* are rotatable round the center shaft 21.

Referring to FIGS. 1, 2, 9 and 10, the take-up spool 8 has a core pipe 40, onto which the leading portion of the stencil 1*a* is adhered so as to be wound therearound. The core pipe 40 has a cut 40*a* at one end thereof.

Figure 10:
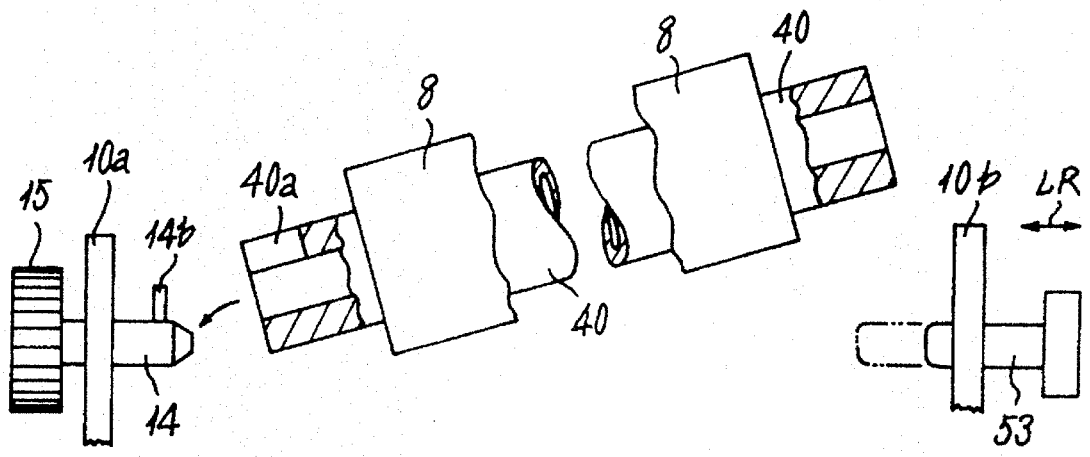
FIG. 10 is a cross-sectional view showing how to load the stencil take-up means.

The take-up spool support 10*a* rotatably supports a shaft 14 at the free end thereof. The shaft 14 has an upright projection 14*b* to be engaged with the cut 40*a* of the core pipe 40 of the take-up spool 8. The other end of the core pipe 40 fits around a slide shaft 53 extending from the take-up spool support 10*b*. In other words, the take-up spool 8 extends between the take-up spool supports 10*a* and 10*b* via the shafts 14 and 53, and is rotatable between these take-up spool supports 10*a* and 10*b*. The shaft 14 includes the gear 15 fixedly attached thereto. The gear 15 serves as a first driven gear. As shown in FIG. 10, the slide shaft 53 is in parallel to the center shaft 21 of the frame 101, and is slidable in the directions shown by a double-headed arrow LR.

The stencil supply unit 70 and the stencil takeup unit 80 are actuated by their associated driving mechanisms (not shown).

During the printing process, the printing drum 20, the stencil supply unit 70, and the stencil takeup unit 80 rotate integrally at a high speed as described in detail later.

A press roller 25 (shown in FIG. 1) is positioned below the printing drum 20, and comes into contact with the outer circumferential surface of the printing drum 20 during the printing process. The press roller 25 is rotatable round a shaft 26, which is supported at its opposite ends by a pair of arms 27. The arms 27 are rotatably supported on a shaft 28 mounted on an immovable member (not shown) of the frame 101. Referring to FIG. 1, a pair of feed rollers 29*a* and 29*b* are disposed right to the shaft 28 so as to convey print sheets 30 from a sheet supply (not shown) into a space between the printing drum 20 and the press roller 25.

The gear 34 for rotating the platen roller 2 is driven by a drive mechanism shown above the stencil web support 7*a* shown in FIG. 4. The drive mechanism comprises a small DC motor (not shown), a rotary shaft 36*s*, a sheet cam 36 integral with the rotary shaft 36*s*, and a cam follower bracket 37A. The DC motor is mounted on an immovable member of the non-illustrated side plate of the stencil duplicating machine. The cam follower bracket 37A has a roller 37*a* in contact with the periphery of the cam 36.

The cam follower bracket 37A is a triangular plate having an arm-like portion as shown in FIG. 4. The bracket 37A receives the roller 37*a* at one corner thereof, and is rotatably supported by the immovable member via a shaft 37*s*. At a free end of the arm-like portion, the bracket 37A is urged to turn clockwise by a spring 37B attached to the immovable member. A pulse motor 37 is disposed along one side edge of the arm-like portion of the bracket 37A, serving as a second drive means. The pulse motor 37 includes a gear 35 which serves as a drive gear and engages with the gear 34 so as to actuate the platen roller 2 at a predetermined timing.

The DC motor, cam 36, cam follower bracket 37A, spring 37B, pulse motor 37, and gear 35 constitute a second actuator.

Figure 5:
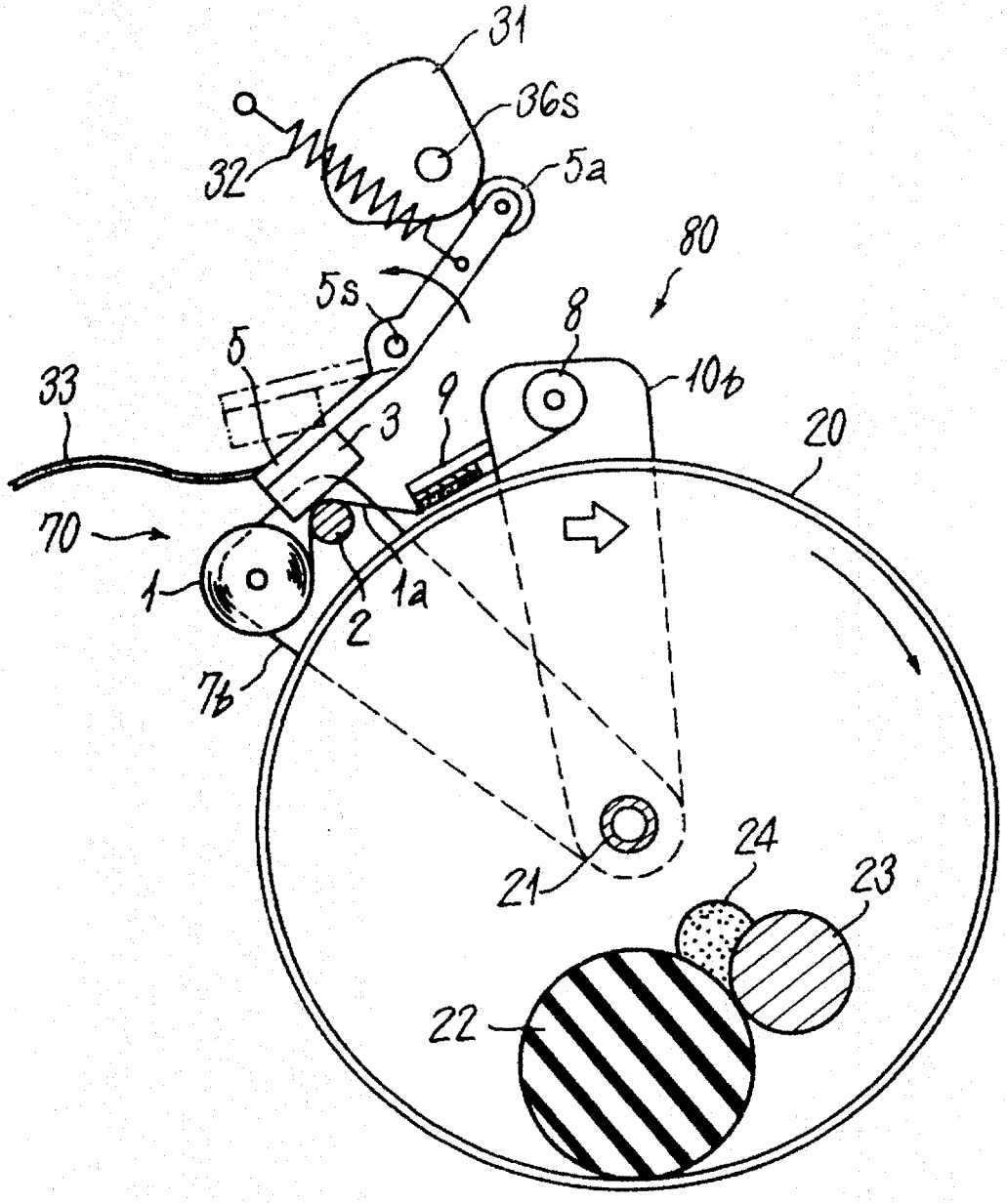
FIG. 5 is a diagrammatic view showing stencil perforating means and its peripheral components.

Referring to FIG. 5, the stencil making section mainly comprises a thermal head 3. The thermal head 3 extends in parallel to the printing drum 20, and comes into contact with the platen roller 2 so as to perforate patterns of the original image on the stencil. The thermal head 3 is attached to a free end of an arm-shaped cam follower bracket 5, which is, at the center thereof, rotatably supported via a shaft 5*s* on the immovable member of the stencil duplicating machine. The cam follower bracket 5 has a roller 5*a* at the other end thereof. The cam follower bracket 5 is urged to turn counterclockwise by a tension spring 32, which is connected to an intermediate position of the cam follower bracket 5 between shaft 5*s* and the roller 5*a*. The tension spring 32 is also connected to the foregoing immovable member.

The roller 5*a* of the cam follower bracket 5 is in contact with a cam 31, which is integrally supported on the cam shaft 36*s* of the cam 36 (shown in FIG. 4). The cam 31 is rotated with the cam 36 by a DC motor. Thus, it is also possible to integrate the cams 31 and 36 into one cam. When the thermal head 3 comes into contact with the platen roller 2, the gears 34 and 35 engage with each other. The DC motor, cam 31, cam follower bracket 5 and spring 32 constitute a first actuator for operating the thermal head 3.

The thermal head 3 is operated by the foregoing mechanism in response to digital image signals which are processed and sent by a document reader (not shown) via a signal wire 33.

Figure 2:
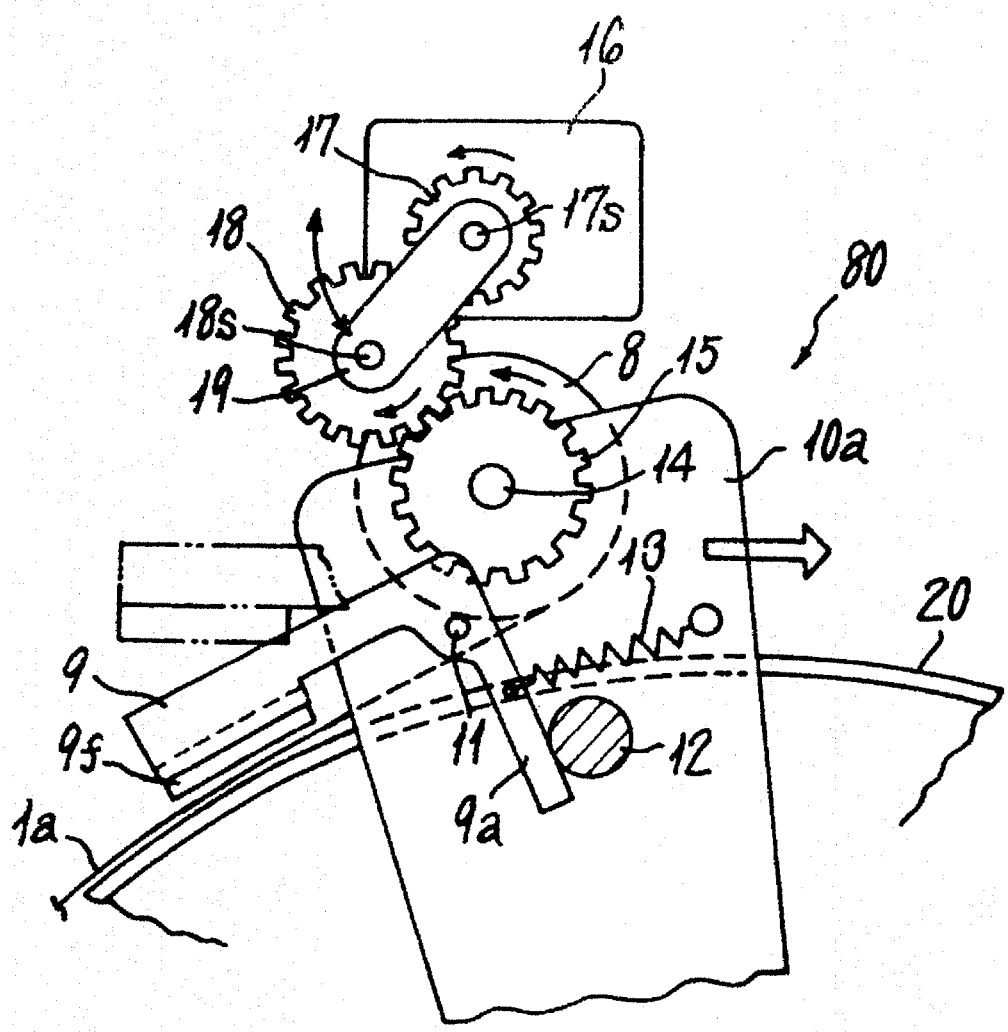
FIG. 2 is a somewhat enlarged, diagrammatic view showing a stencil take-up unit and its peripheral components for the stencil duplicating machine of FIG. 1.
Figure 3:
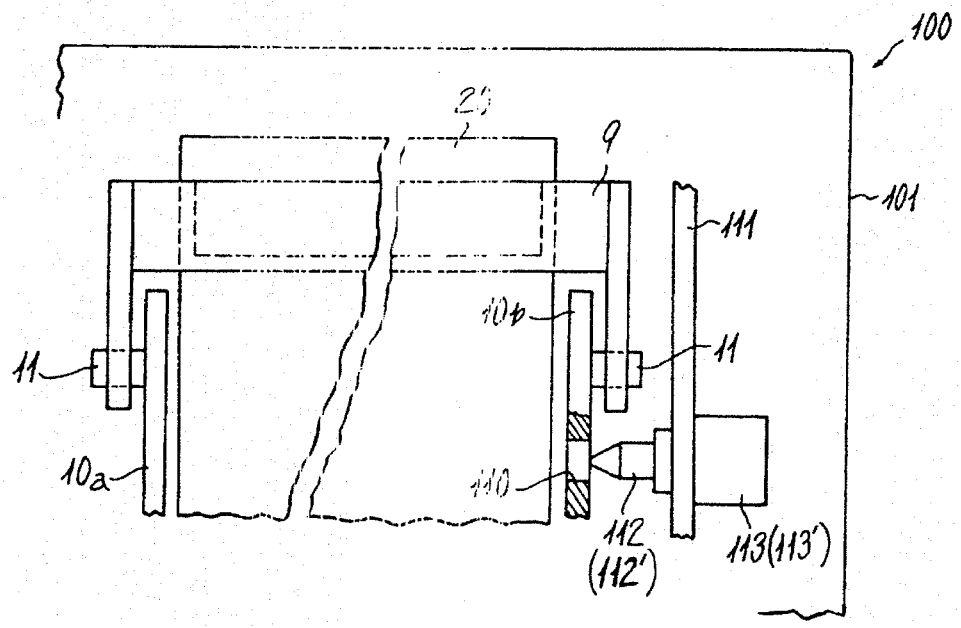
FIG. 3 is a top plan view showing the main part of positioning means and its peripheral components related to the stencil take-up process.

FIG. 2 also shows a clamp 9, which is disposed near the take-up spool 8 so as to hold the stencil 1*a* on the outer circumferential surface of the printing drum 20. The clamp 9 is movably supported on a shaft 11 extending between the take-up spool supports 10*a* and 10*b*. Referring to FIGS. 2 and 3, the clamp 9 includes a flat friction plate 9*f* to come into contact with the outer surface of the printing drum 20, and a pair of projecting portions 9*a* located near the takeup spool supports 10*a* and 10*b*. The clamp 9 is in the shape of letter L near the take-up spool supports 10*a* and 10*b*, and is connected to the tension springs 13 at the centers of the projecting portions 9*a*. Thus, the clamp 9 is normally urged to press the stencil 1*a* onto the outer surface of the printing drum 20 (counterclockwise in FIG. 2). Pins 12 (shaded portion in FIG. 2) are provided on the immovable member of the frame 101, and are operated by a solenoid (not shown) to project in parallel to the shaft 11 of the clamp 9, thereby coming into contact with the clamp 9 at the predetermined timing to be described later.

The stencil take-up spool 8 is operated by a motor 16 as first drive means, which is shown in FIG. 2 and is attached to the immovable member of the frame 101. The motor 16 includes a power output shaft 17*s*, and a gear 17 fixedly attached to the power output shaft 17*s*. The power output shaft 17*s* is connected, via a link 19, to a shaft 18*s* on which a gear 18 is rotatably supported. Thus, the gear 17 serves as a frist drive gear, and is in continuous engagement with the gear 18 functioning as a first intermediate drive gear. The drive gear 17 is engaged with the driven gear 15 via the first intermediate drive gear 18.

The link 19 rocks to engage and disengage the gear 18 with and from the gear 15 at a predetermined timing as will be described later. The rocking motion of the link 19 is assured by the gear 17 which is rotated by the motor 16, since the power output shaft 17*s*, shaft 18*s* and shaft 14 are positioned in such a manner that a half line connecting the power output shaft 17*s* and the shaft 18*s* forms an approximate right angle or an obtuse angle with a half line connecting the shaft 14 and the shaft 18*s*. Specifically, when the stencil making process is started as will be described later, the gear 17 of the motor 16 turns counterclockwise, so that the link 19 causes the gear 18 to engage with the gear 15. Thus, the rotational force of the motor 16 is transmitted to the shaft 14. Conversely, at the completion of the stencil making process, the gear 17 is rotated slightly clockwise, so that the link 19 causes the gear 18 to be disengaged from the gear 15. This mechanism can assure the rocking motion of the link 19 without addition of a special motor or solenoid for operating the link 19.

Referring to FIG. 9, a pair of members 51 are used for temporarily holding the stencil web 1 and the take-up spool 8 when loading them in the stencil duplicating machine, and is made of plastics. Each of the members 51 has openings 51*a* for receiving the stencil web 1 and openings 51*b* for receiving the takeup spool 8. The stencil web 1 and the take-up spool 8 supported on the members 51 are supplied as a unit 200. The openings 51*a* and 51*b* of the members 51 are spaced by a distance which is equal to the distance between the opening 52*a* (52*b*) of the stencil web support 7*a* (7*b*) and the shaft 14 of the take-up spool support 10*a* (10*b*). The take-up spool 8 and the stencil web 1 are loaded onto the stencil duplicating machine in this order. Then, the members 51 will be removed.

As shown in FIG. 3, a plunger protruding type solenoid 113 is disposed on a side plate 111 of the stencil duplicating machine 100. The solenoid 113 has a guide pin 112 which can project in parallel to the shaft 11 rotatably supporting the clamp 9 thereon. When projecting, the guide pin 112 fits into an opening 110 at the lower part of the take-up spool support 10*b*. Specifically, the solenoid 113 and opening 110 serve as second positioning means for the take-up spool support 10*b*.

Another solenoid 113' is disposed at a predetermined position of the side plate, and has a guide pin similar to the guide pin 112 mentioned above. This solenoid serves as first positioning means in cooperation with an opening 110' on the stencil web support 7*a*.

In operation, to start the printing, the stencil take-up process is carried out prior to the stencil making process. When a stencil making switch (not shown) is turned on, a related solenoid (not shown) is operated to let the pin 12 project in parallel to the shaft 11 as shown in FIG. 2. The pin 12 comes into contact with the projecting portion 9*a* of the clamp 9. Then, the take-up spool supports 10*a* and 10*b* move clockwise to a preset distance as shown by a large arrow, which moves the clamp 9 to an open position shown by a dashed line. Thereafter, the solenoid 113 is driven to project the guide pin 112 as shown in FIG. 3. The guide pin 112 fits into the opening 110 of the take-up spool support 10*b*, so that the take-up spool supports 10*a* and 10*b* are engaged with the immovable member of the frame 101. Referring to FIG. 2, the link 19 rocks downwards round the power output shaft 17*s*, and the gears 18 and 15 engage with each other. Thus, the stencil take-up motor 16 is rotated, allowing the take-up spool 8 to turn counterclockwise.

Figure 11:
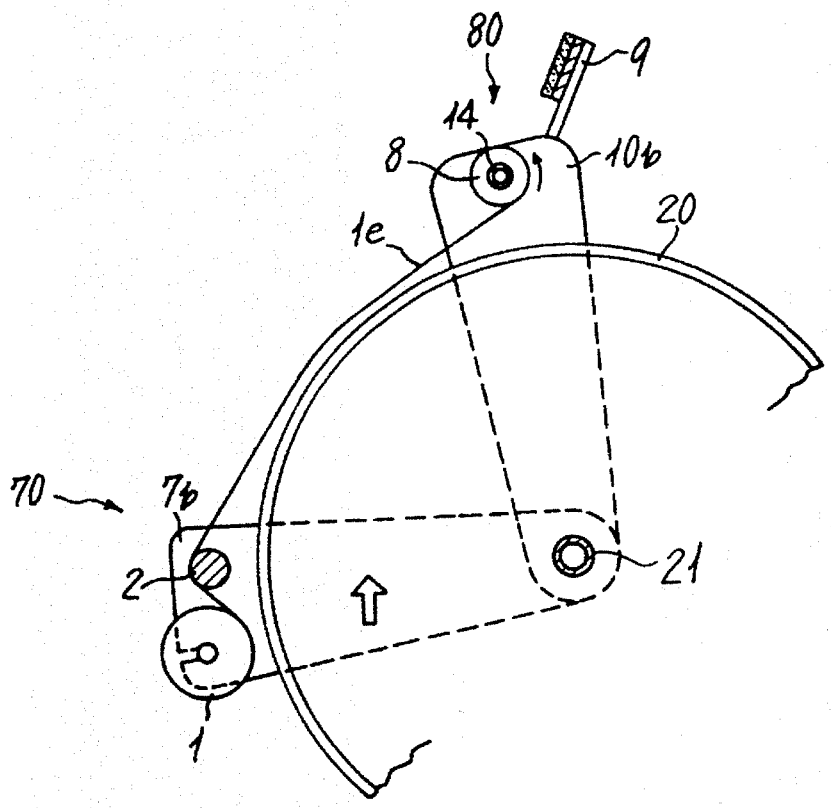
FIG. 11 is a diagrammatic view showing the main part related to the stencil take-up process.

Concurrently with the foregoing operation, first claws (not shown) of the stencil web supports 7*a* and 7*b* engage with first dents on the printing drum 20, so that the printing drum 20 and the stencil web supports 7*a* and 7*b* integrally rotate clockwise as shown in FIG. 1. In this state, a portion 1*e* (shown in FIG. 11) of the used stencil 1*a* extending between the platen roller 2 and the take-up spool 8 is applied with a constant and uniform tension, which is produced by the take-up spool 8 actuated by the stencil take-up motor 16 (shown in FIG. 2) rotated at a speed slightly higher than a rotation speed of the printing drum 20 by utilizing internal slip of a DC motor. The printing drum 20 keeps on rotating with the stencil portion 1*e* applied with the foregoing tension, so that the used stencil is wound around the take-up spool 8. Finally, the stencil supply unit 80 and the stencil take-up unit 70 are relatively positioned as shown in FIG. 5. Further, before the clamp 9 returns to the surface of the printing drum 20, the stencil web supports 7*a* and 7*b* are engaged with the immovable member via the first positioning means. Then, only the printing drum 20 free from the used and inked stencil sticking thereto is rotated counterclockwise. The printing drum 20 is reversely rotated until the print zone P of the printing drum 20 coincides with the start position SP for the stencil making process (shown in FIG. 7).

When the printing drum 20, the stencil web supports 7*a* and 7*b*, and the take-up spool supports 10*a* and 10*b* are positioned as shown in FIG. 5, the pin 12 (FIG. 2) withdraws in a direction parallel to the shaft 11. Thus, the clamp 9 is urged to close by the spring 13, holding the leading portion of the stencil 1*a* onto the outer surface of the printing drum 20, so that the stencil take-up process is completed.

Figure 7:
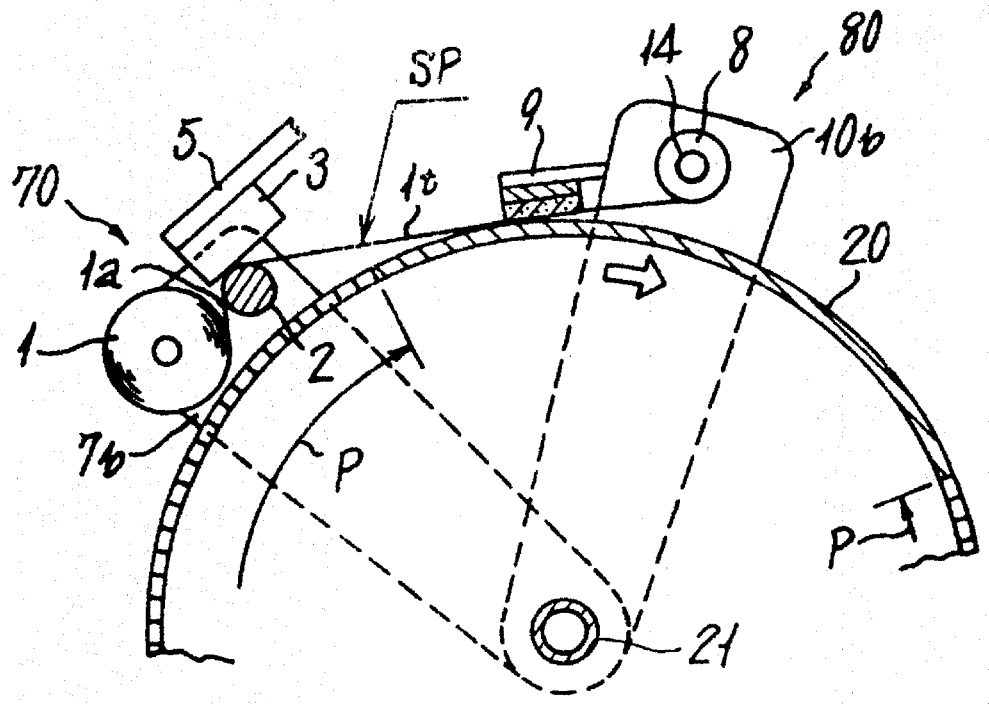
FIG. 7 is a diagrammatic view similar to the view shown in FIG. 6, but illustrating the beginning of the stencil perforating process.

Thereafter, the cam 31 is rotated by the DC motor (not shown), and the cam follower bracket 5 is urged to turn counterclockwise round the shaft 5*s* by the spring 32, thereby pushing heat emitting elements of the thermal head 3 to the stencil 1*a* on the platen roller 2. As shown in FIG. 7, the start position SP where the heat emitting elements of the thermal head 3 begin perforating the stencil is set to coincide with the leading portion of the print zone P of the printing drum 20. Since the clamp 9 holds the stencil 1*a* in such a manner as to make the start position SP coincident with the print zone P, the stencil perforating process can be reliably started at the start position SP. The stencil perforating process is started when the components related to the stencil perforation have the positional relationship as shown in FIG. 5. In other words, the stencil perforating process is carried out on the stencil 1*a* which is being paid out from the stencil web 1. In response to the digital image signal from the document reader (not shown), the heat emitting elements are selectively heated to perforate patterns of the original image on the stencil 1*a*.

The cams 31 and 36 are turned clockwise by their associated DC motor (not shown) as shown in FIG. 4. When a large diameter portion of the cam 36 comes into contact with the roller 37*a*, the cam follower bracket 37A turns round the shaft 37*s* against the spring 37B, enabling the gear 35 to engage with the gear 34. In this state, the pulse motor 37 is driven to rotate the gear 34 and the platen roller 2 clockwise, so that the stencil 1*a* will be successively paid out from the stencil web 1. The heat emitting elements of the thermal head 3 are selectively heated to perforate the stencil 1*a* from the leading part thereof. At the same time, the solenoid 113 (FIG. 3) is turned off, the guide pin 112 withdraws from the opening 110 of the take-up spool support 10*b*, and the take-up spool supports 10*a* and 10*b* are disengaged from the immovable member. Thereafter, the take-up spool supports 10*a* and 10*b* become integral with the printing drum 20 via the second claws thereof which fit into the second dents of the drum 20. Thus, the printing drum 20 and the take-up spool supports 10*a* and 10*b* rotate clockwise together to attain the positional relationship shown in FIG. 7 from that shown in FIG. 5. In this state, the part it of the stencil extending between the platen roller 2 and the clamp 9 is applied with a predetermined tension since the printing drum 20 is rotated by its drive means via the slip ring (neither the drive means nor the slip ring are shown in FIG. 7). Thus, the printing drum 20 keeps on rotating with the predetermined tension applied to the stencil 1*t*, so that the stencil having perforated patterns thereon is wrapped around the printing drum 20.

Figure 6:
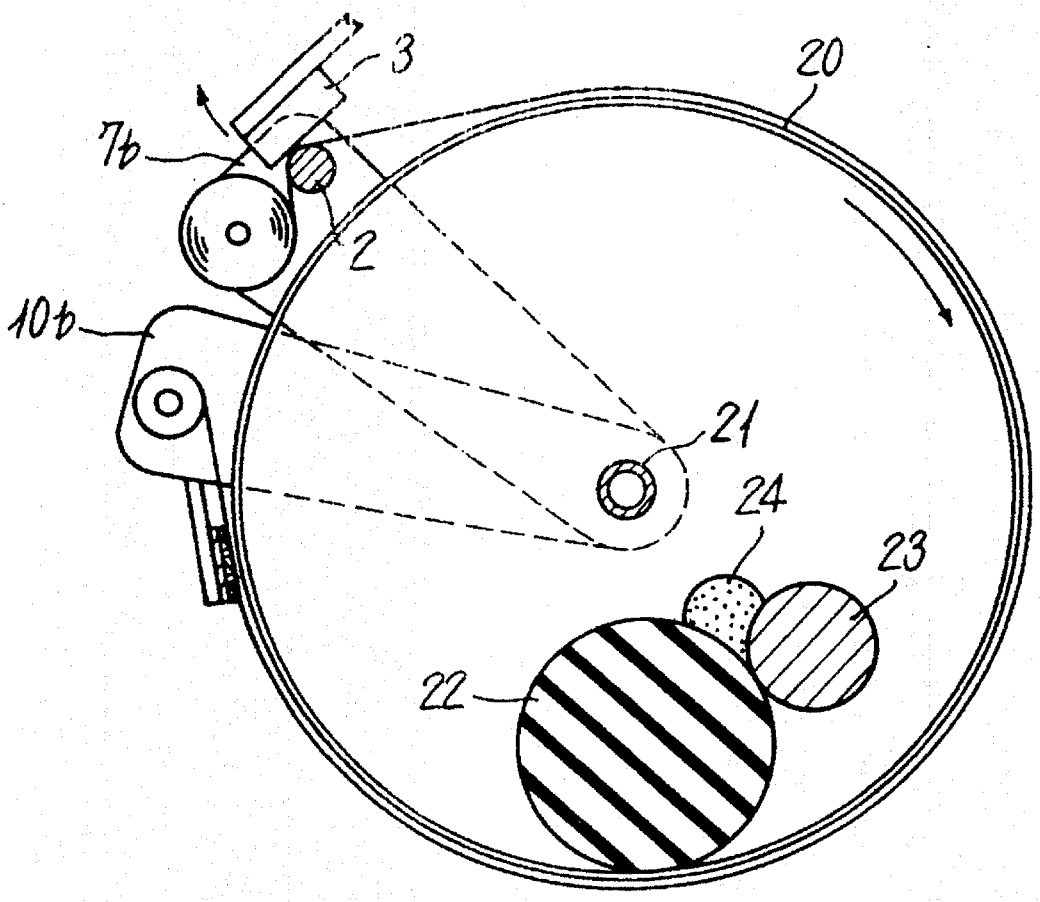
FIG. 6 is a diagrammatic view showing the state of the stencil perforating means after the stencil perforating process.

When the stencil carrying the perforated patterns thereon is completely wound around the printing drum 20 upon the completion of the stencil perforating process, the printing drum 20, the stencil supply unit 70 (i.e. the stencil web supports 7*a* and 7*b*), and the stencil take-up unit 80 (i.e. the take-up spool supports 10*a* and 10*b*) have the positional relationship as shown in FIG. 6, so that the thermal head 3 is lifted to leave from the platen roller 2 as shown by an arrow by further rotation of the cam 31 (FIG. 5). Thereafter, the printing drum 20, stencil supply unit 70 and stencil take-up unit 80 rotate together slightly clockwise to reach the home position as shown in FIG. 1 since the first and second claws engage with their associated first and second dents.

The printing process is started from the home position. Print sheets 30 are conveyed by a sheet feeder (not shown) from a sheet stack (not shown) to the sheet feed rollers 29*a* and 29*b*. These rollers 29*a* and 29*b* feed each print sheet 30 into a space between the outer circumferential surface of the printing drum 20 and the press roller 25 synchronously with the rotation of the printing drum 20. The press roller 25 is lifted by the rocking motion of the arm 27 to a position where it presses the print sheet 30 against the printing drum 20 via the stencil carrying the perforated patterns of the original image. Thereafter, ink is oozed out to the print sheet 30 via the apertured portions of the printing drum 20 and the stencil. During the printing process, the inking roller 22 also rotates with the printing drum 20 in the same direction to supply ink to the inner circumferential surface of the printing drum 20. The print sheet 30 after being printed is separated from the outer surface of the printing drum 20 by sheet separating means (not shown), conveyed by another sheet feeder (not shown), and discharged onto a tray.

Figure 8:
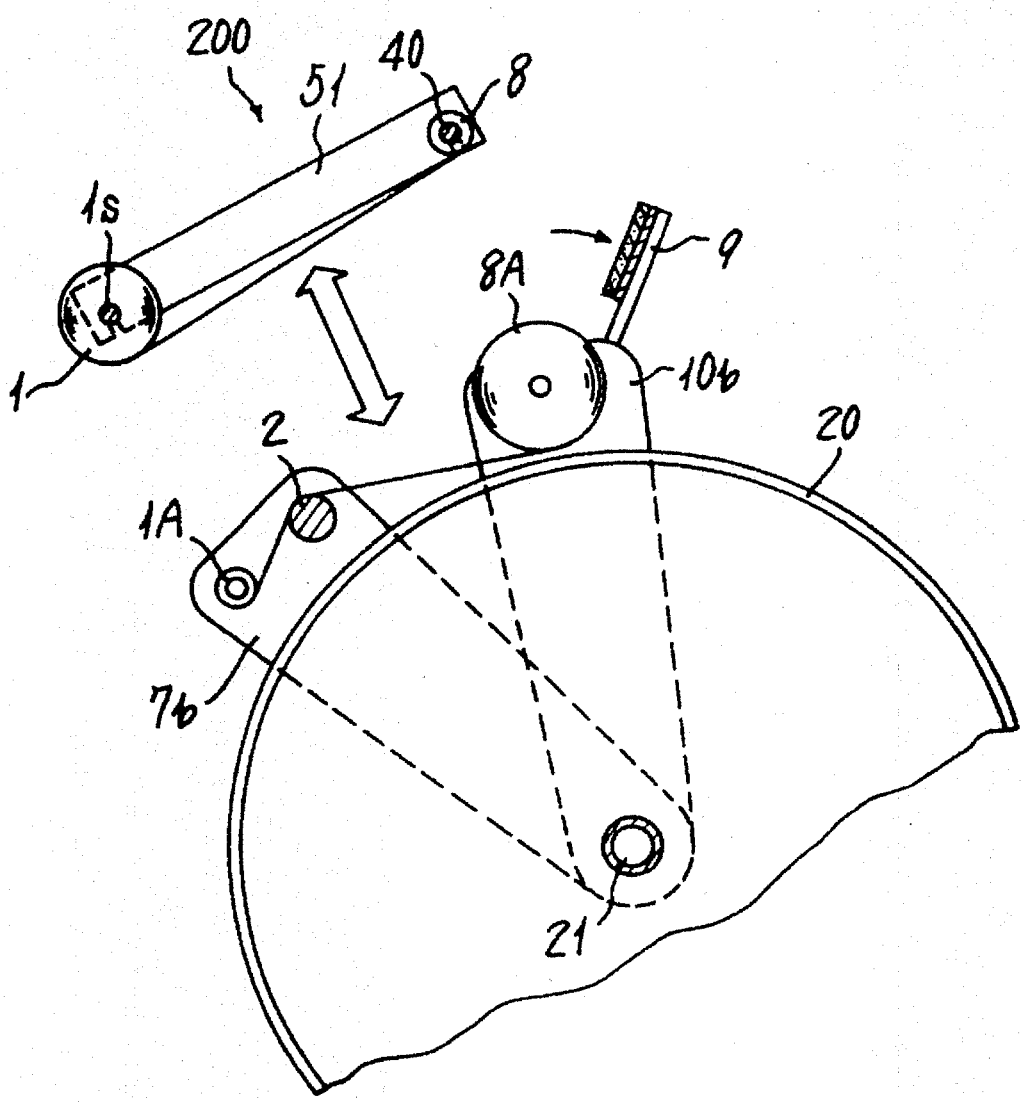
FIG. 8 is a diagrammatic view showing how to load or unload a stencil web and stencil take-up means.

An empty stencil web 1 and a filled take-up spool 8 will be replaced with new ones when the printing drum 20, stencil web supports 7*a* and 7*b*, and takeup spool supports 10*a* and 10*b* are relatively positioned as shown in FIG. 5. First of all, the clamp 9 is fully opened as shown in FIG. 8, so that the empty stencil web 1A and the filled take-up spool 8A are removed from their associated supports 7*a*, 7*b*, 10*a* and 10*b*, respectively. A new stencil web 1 and an empty take-up spool 8 which are held on the temporary supports 51 are loaded between the stencil web supports 7*a* and 7*b*, and between the take-up spool supports 10*a* and 10*b*, respectively. Specifically, first of all, the cut 40*a* on the core 40 of the take-up spool 8 is engaged with the projection 14*b* of the shaft 14 on the take-up spool support 10*a*. The core 40 of the take-up spool 8 is pushed toward the shaft 14, and is fitted at its other end around the slide shaft 53 on the take-up spool support 10*b* as shown by the dashed line in FIG. 9. Thereafter, the core 1*s* of the stencil web 1 is pushed into the cavities 52*a* and 52*b* of the stencil web supports 7*a* and 7*b*. Then, the temporary supports 51 will be removed. Thus, the temporary supports 51 enable the stencil web 1 to be reliably loaded without any inconveniences such as skewing.

FIGS. 12 to 17 show a stencil supply unit 70A and a stencil take-up unit 80A in which some modifications are made to stencil web supports and stencil take-up spool supports. The stencil duplicating machine 100A is substantially the same as the stencil duplicating machine 100 shown in FIG. 1, but also includes the following components.

The stencil supply unit 70A includes third claws 71, while the stencil take-up unit 80A includes fourth claws 81. Pins 120 (shown in FIG. 14) for maintaining the stencil supply unit 70A and/or the stencil take-up unit 80A at a predetermined position with respect to the printing drum 20 are disposed on the immovable member of the duplicating machine 100A. Pins 78 for enabling integral operation of the stencil supply unit 70A and the stencil take-up unit 80A are disposed on given positions of the flanges 20E of the printing drum 20. The claws 71 and 81 are selectively engaged with the pin 120 or the pin 78. Specifically, the claws 71 and 81 are engaged with the pin 120 during the reverse rotation of the printing drum 20. Either the claws 71 or 81 are engaged with the pins 78 during the initial stencil setting process. The pins 120 and 78, and third and fourth actuators (not shown) are positioned on the flanges 20E in such a manner that they do not interfere with the rotation of the printing drum 20.

Figure 12:
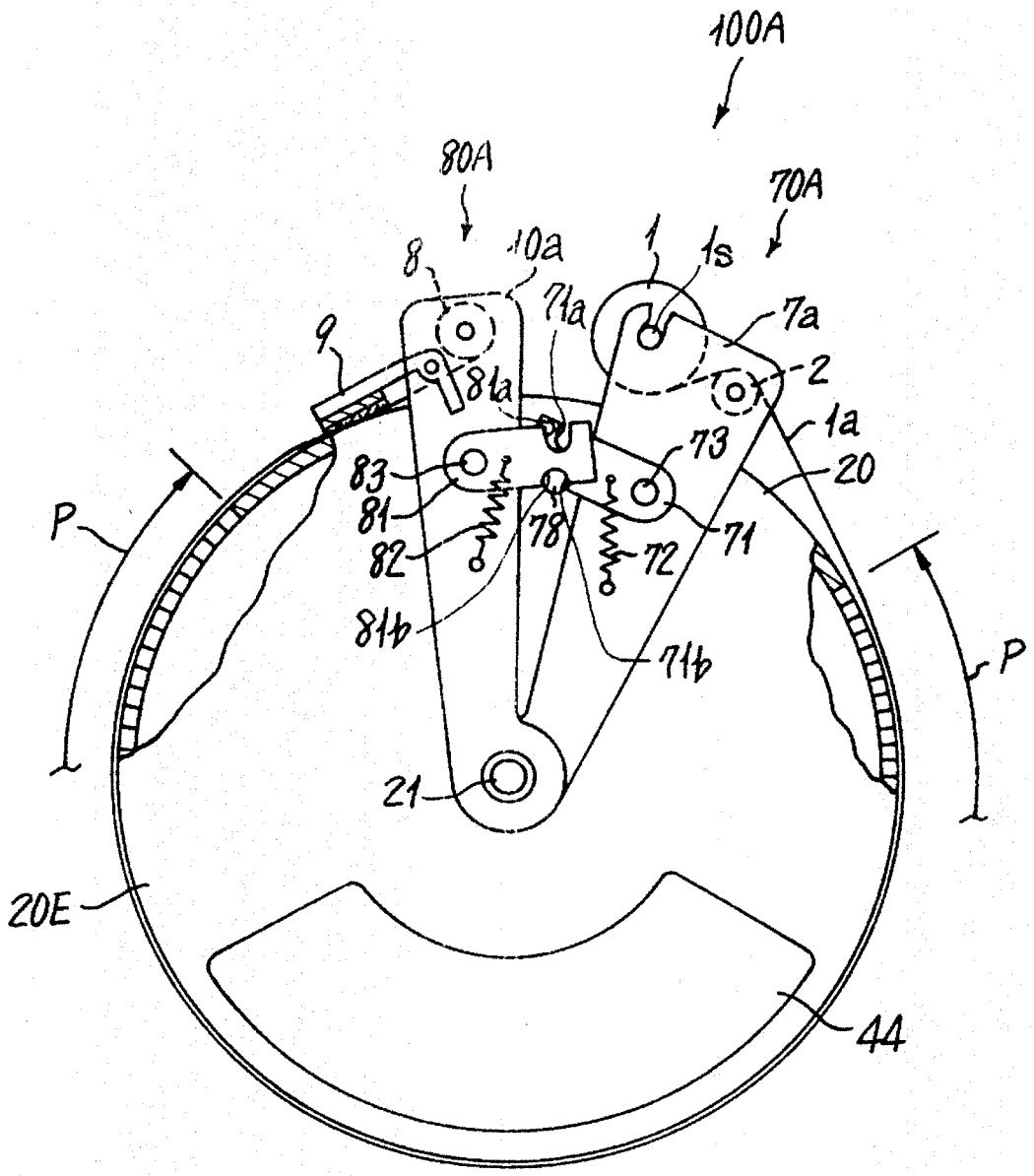
FIG. 12 is a diagrammatic view showing the main part of the stencil duplicating machine of FIG. 1 to which some modifications are made, and also showing the printing process.
Figure 13:
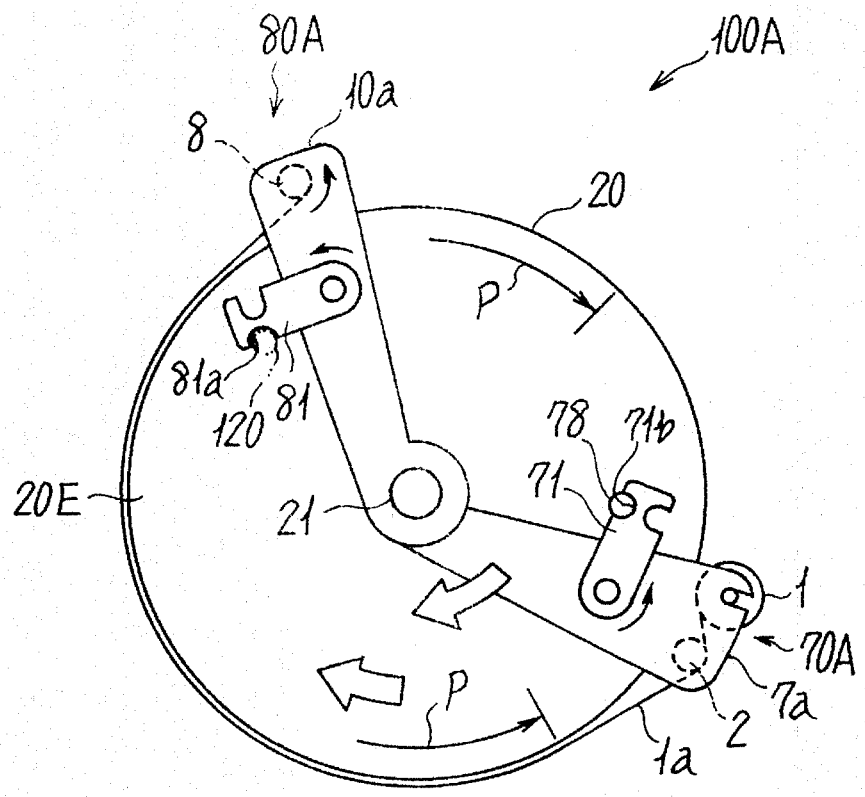
FIG. 13 is a diagrammatic view showing components related to the stencil take-up process in the machine of FIG. 12.

Referring to FIGS. 12 and 13, each third claw 71 of the stencil supply unit 70A is rotatably supported by a pin 73 embedded in the stencil web support 7*a* (7*b*) at a position near the free end thereof, and has dents 71*a* and 71*b* on opposite side edges thereof so as to be selectively engaged with the pin 120 or 78. Further, a tension spring 72 is disposed between a pin near the center of the stencil web support 7*a* (7*b*) and an opening on the claw 71.

Every fourth claw 81 of the stencil take-up unit 80A is rotatably supported by a pin 83 embedded in the take-up spool support 10*a* (10*b*) at the free end thereof. The fourth claw 81 has dents 81*a* and 81*b* to be selectively engaged with the pin 120 or 78 similarly to the claw 71 of the stencil supply unit 70A. A tension spring 82 is disposed between a pin near the center of the take-up spool support 10*a* (10*b*) and an opening on the claw 81.

The third and fourth actuators (not shown) are positioned near the pin 120 to respectively move the third and fourth claws 71 and 81 in predetermined directions so that the third and fourth claws 71 and 81 engage with the pin 120.

The operation of the stencil duplicating machine 100A will be described hereinafter with respect to the modified parts thereof. The gears 15 and 34, clamp 9, and springs 72 and 82 are omitted in FIGS. 12 to 17 for simplification.

In the stencil take-up process, the start key is turned on. The projecting portions 9*a* of the clamp 9 come into contact with the pins 12 as shown in FIG. 2, so that the take-up spool supports 10*a* and 10*b* are moved to a certain extent in the direction shown by a large arrow. Thus, the clamp 9 is opened as shown by a dashed line.

When turned counterclockwise by the fourth actuator as shown in FIG. 13, the fourth claw 81 engages with the pin 120 in the dent 81*a* thereof, so that the take-up spool supports 10*a* and 10*b* are engaged with the immovable member. Thereafter, the take-up motor 16 is operated to rotate the take-up spool 8 counterclockwise as shown in FIG. 2.

Figure 14:
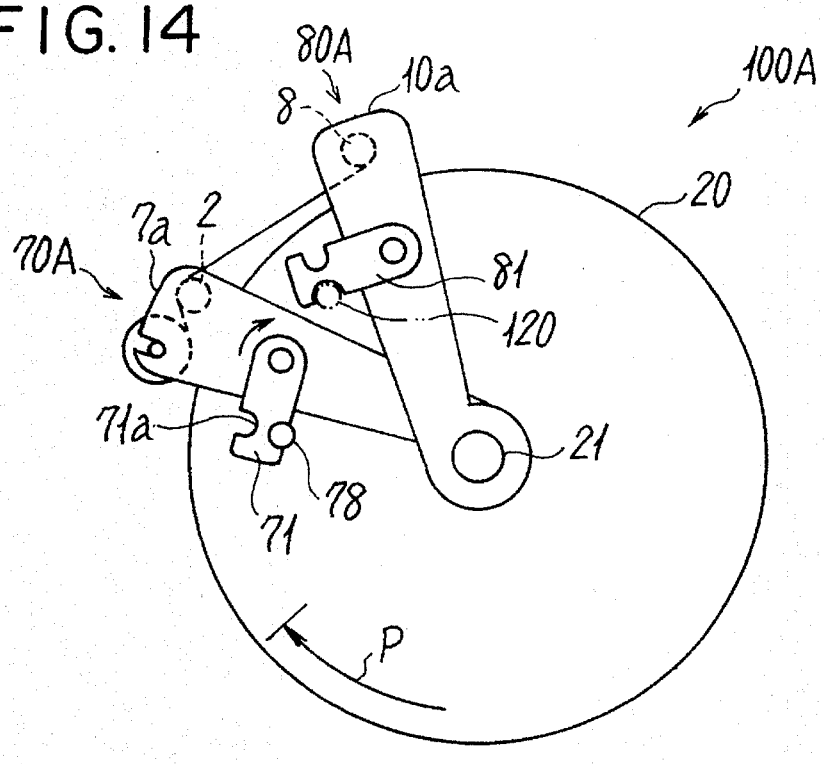
FIG. 14 is a diagrammatic view similar to the view shown in FIG. 13, but illustrating the completion of the stencil take-up process.
Figure 15:
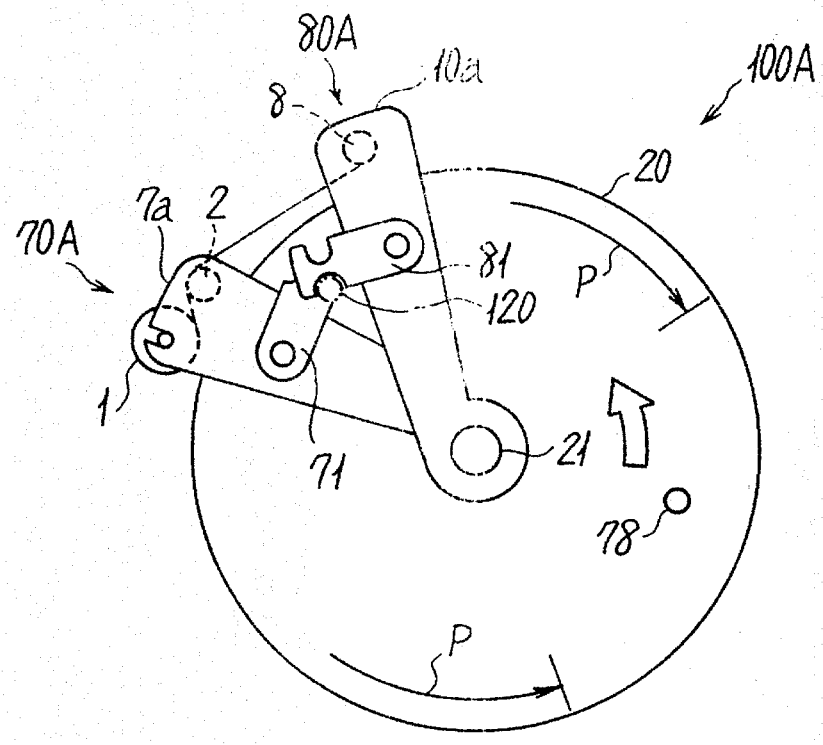
FIG. 15 is a diagrammatic view showing the idling of the printing drum just before the completion of the stencil take-up process.

Concurrently with the foregoing operation, the third actuator turns the third claw 71 counterclockwise, which then engages with the pin 78. Thus, the printing drum 20 and the stencil web supports 7*a* and 7*b* integrally rotate in the direction shown by the large arrow. In this state, the used portion 1*e* of the stencil extending between the platen roller 2 and the take-up spool 8 is applied with the predetermined uniform tension as described with reference to FIG. 11. The printing drum 20 rotates with the predetermined tension applied to the stencil portion 1*e*, so that the stencil portion 1*e* is taken up onto the take-up spool 8. Finally, the stencil supply unit 70A reaches the position as shown in FIG. 14. In other words, when the printing drum 20, the stencil web supports 7*a* and 7*b*, and the take-up spool supports 10*a* and 10*b* are relatively positioned as shown in FIG. 14, the printing drum 20, stencil web supports 7*a* and 7*b*, and the take-up spool 8 stop rotating.

The third actuator turns the third claws 71 of the stencil supply unit 70A clockwise so that the third claws 71 engage with the pins 120 at the dents 71*a* thereof. The stencil web supports 7*a* and 7*b* are engaged with the immovable member. Thereafter, the take-up spool supports 10*a* and 10*b* also engage with their immovable member via the pins 120. In this state, only the printing drum 20 reversely rotates (counterclockwise) as shown by the large arrow in FIG. 15. In other words, the printing drum 20 rotates idly so that the print zone P thereof coincides with the start position of the stencil perforation. This process prevents waste of the stencil.

The clamp 9 is then closed as shown in FIG. 2, thereby holding the leading portion of the stencil 1*a* on the outer surface of the printing drum 20. Thus, the stencil take-up process is completed.

Figure 16:
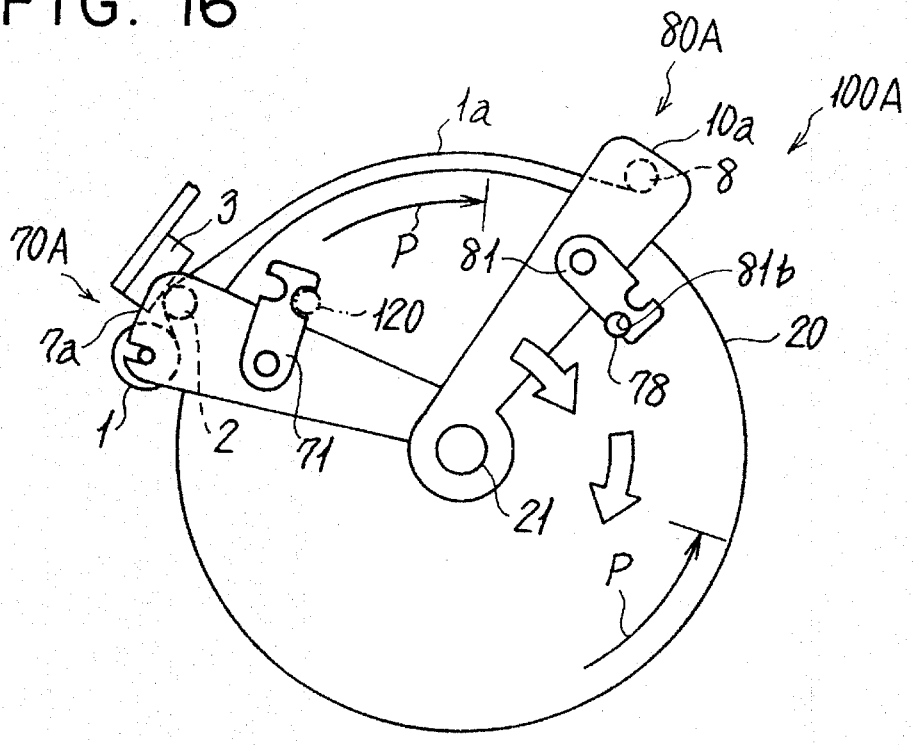
FIG. 16 is a diagrammatic view showing the positional relationship between the stencil supply unit and the stencil take-up unit while the stencil perforating and supplying processes are in progress.

Referring to FIG. 16, the stencil web supports 7*a* and 7*b* are engaged with the pin 120 and remain engaged with the immovable member. In this state, the thermal head 3 is pressed to the stencil 1*a* on the platen roller 2 so as to perforate patterns of the original image on the stencil 1*a*. Thereafter, the fourth actuator operates to disengage the take-up spool supports 10*a* and 10*b* from the pins 120 and engages them with the pins 78 at the dents 81*b*. Thus, the take-up spool supports 10*a* and 10*b* as well as the printing drum 20 rotate clockwise as shown by the large arrows. As described above, the stencil perforating process is started at the position SP of the stencil 1*a* which is on the print zone P of the printing drum 20. As described with reference to FIG. 7, the stencil 1*a* after perforation is wound around the outer surface of the printing drum 20 which is rotated while applying the predetermined tension to the portion it of the stencil.

Figure 17:
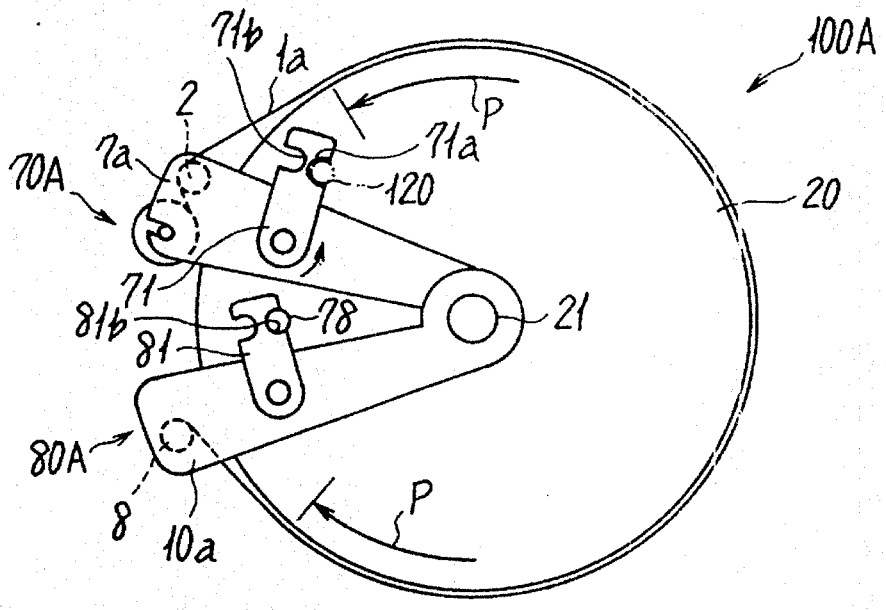
FIG. 17 is a diagrammatic view similar to FIG. 16 but showing the completions of the stencil perforating and supplying processes.
Figure 18:
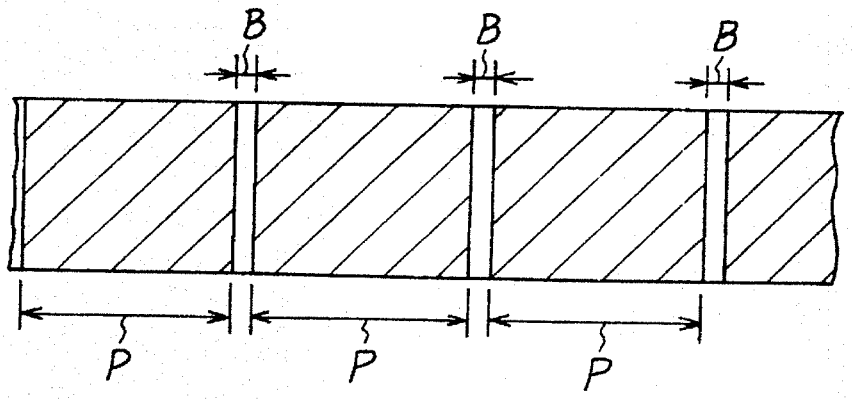
FIG. 18 shows the relationship between print positions and non-print positions on the stencil in the stencil duplicating machine of the present invention.
Figure 19:
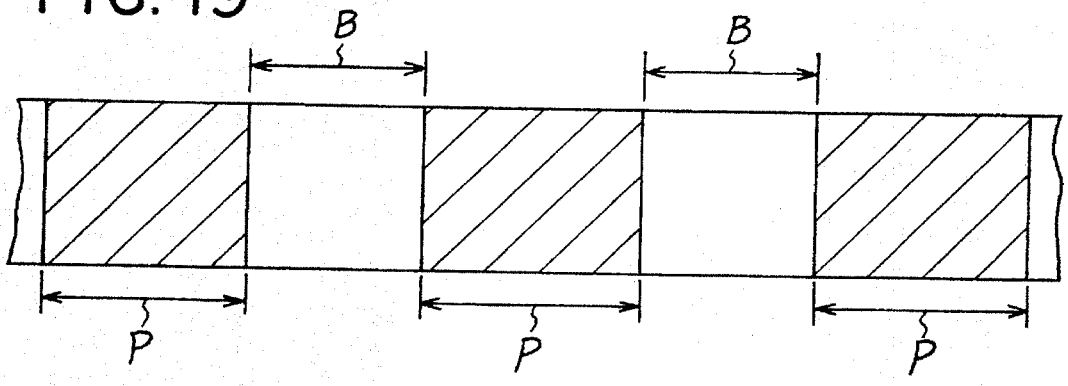
FIG. 19 is a view similar to the view shown in FIG. 18, but illustrating the stencil in the prior art stencil duplicating machine.

When the stencil making process is completed and the stencil 1*a* is wound around the printing drum 20, i.e. the printing drum 20, the stencil supply unit 70A and the stencil take-up unit 80A are relatively positioned as shown in FIG. 17, the thermal head 3 leaves from the platen roller 2. Thus, the stencil making and supplying processes are completed.

The operation of a third actuator (not shown) turns the third claw 71 counterclockwise, which engages with the pin 78 via the dent 71*b*. Thus, the printing drum 20 becomes integral with the stencil web supports 7*a* and 7*b*. Thereafter, the printing drum 20, stencil web supports 7*a* and 7*b*, and the take-up spool supports 10*a* and 10*b* integrally rotate clockwise to the preset extent to the position as shown in FIG. 12. Then, the printing process will be started.

The tension springs 72 and 82 assure the selective and reliable engagement with the third and fourth claws 71 and 81 and the pins 120 and 78, respectively.

The press roller 25 is used in the present invention to press the print sheet 30 against the printing drum 20. Alternatively, the press roller 25 may be a pressure cylinder which is as thick as the printing drum 20, as disclosed in Japanese Patent Laid-Open Publication No. Sho 62-73987. In such a case, since it is required to rotate in a timed relationship with the rotation of the printing drum 20, the pressure cylinder is formed with a recessed area on the outer circumferential surface thereof so that the components sticking out over the printing drum 20, such as the stencil web 1 and take-up spool 8, can fit into the recessed area. While no printing is carried out, the pressure cylinder axially rotates to only a small extent so as to prevent ink from sticking to the pressure cylinder, which is effective to reduce noise or vibrations.

As described so far, the stencil is made substantially of only a thin thermo-plastic resin film whose thickness is approximately 2 μm to 5 μm, i.e. a so-called baseless stencil. It is also possible to use an ordinary stencil including Japanese paper as a base material.

In the present invention, the rotational force of the stencil take-up motor 16 or the pulse motor 37 can be reliably transmitted by engagement or disengagement of the gear 15 (for the take-up spool 8), gear 34 (for the platen roller 2) with or from the gear 18, and the gear 35, respectively.

The stencil perforating process is performed after the trailing portion of the used stencil is taken up onto the take-up spool 8. As shown in FIG. 5, the fresh stencil is paid out from the stencil web 1 onto the outer surface of the printing drum 20 to the predetermined extent. Then, the stencil perforating step is started at the position SP of the stencil 1*a* which is in agreement with the print zone P of the printing drum 20, thereby reducing a blank portion B of the stencil 1*a* where no perforation is conducted, and preventing waste of the stencil 1*a*.

Even when the stencil is made substantially of only a very thin thermo-plastic resin film, it can be wound around the printing drum without problems such as skewing or wrinkles since the stencil is not cut. Further, the stencil supply unit and the stencil takeup unit can operate independently. The stencil takeup process can be performed without paying out the stencil from the stencil web. The stencil perforating and supplying processes can be started when the stencil is at the optimum position on the printing drum.

The leading portion of the stencil is reliably held on the printing drum by the clamp.

The stencil making section comes into contact with the platen roller only during the stencil perforating process. Thus, it is not necessary to rotate the heavy thermal head with the printing drum. It is also not necessary to use an expensive but unreliable coupling connector for supplying electrical signals to the thermal head.

The drive means for the take-up spool and the platen rollers are disposed separately from the printing drum, and are not rotated with the printing drum, so that the printing drum has a small inertia.

What is claimed is:

1. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil; and a clamp for holding a leading portion of the stencil on said rotary cylindrical drum, said clamp being disposed near said stencil take-up means and being able to be opened and closed.

2. A stencil duplicating machine as in claim 1, wherein said stencil supply unit and said stencil take-up unit include positioning means for positioning themselves to be adjacent each other with respect to said printing drum while there is no stencil present on the surface of said printing drum.

3. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil; and an immovable frame or member, wherein said stencil making section includes a platen roller for conveying the stencil thereon and stencil perforating means which is independent from said platen roller and is supported by said immovable frame or member, wherein said stencil perforating means comes into contact with said platen roller so as to perforate the original image pattern on the stencil passing over said platen roller, wherein said stencil take-up means includes a first driven gear, said platen roller includes a second driven gear, and said immovable frame or member has a first drive gear engaged with said first driven gear, first drive means for driving said first drive gear, a second drive gear engaged with said second driven gear, and second drive means for driving said second drive gear.

4. A stencil duplicating machine as in claim 3, wherein said stencil supply unit and said stencil take-up unit include positioning means for positioning themselves to be adjacent each other with respect to said rotary cylindrical drum while there is no stencil present on the surface of said drum.

5. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil;

an immovable frame or member, wherein said stencil making section includes a platen roller for conveying the stencil thereon and stencil perforating means which is independent from said platen roller and is supported by said immovable frame or member, wherein said stencil perforating means comes into contact with said platen roller so as to perforate the original image pattern on the stencil passing over said platen roller; and first and second positioning means, wherein said stencil supply unit is engageable with said immovable frame or member via said first positioning means and independent of said stencil supply unit said stencil take-up unit is engageable with said immovable frame or member via said second positioning means.

6. A stencil duplicating machine as in claim 5, wherein said stencil supply unit and said stencil take-up unit include positioning means for positioning themselves to be adjacent each other with respect to said drum while there is no stencil present on the surface of said drum.

7. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil;

an immovable frame or member, wherein said stencil making section includes a platen roller for conveying the stencil thereon and stencil perforating means which is independent from said platen roller and is supported by said immovable frame or member, wherein said stencil perforating means comes into contact with said platen roller so as to perforate the original image pattern on the stencil passing over said platen roller; and a first actuator for urging said stencil perforating means toward said platen roller, and a second actuator for transmitting rotational force to said platen roller, said first and second actuators being disposed in said immovable frame or member and being driven by common driving means.

8. A stencil duplicating machine as in claim 7, wherein said stencil supply unit and said stencil take-up unit include positioning means for positioning themselves to be adjacent each other with respect to said drum while there is no stencil present on the surface of said drum.

9. A stencil duplicating machine comprising: a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil;

third positioning means for holding said stencil supply unit and/or said stencil take-up unit at predetermined positions with respect to said rotary cylindrical drum;

fourth positioning means for holding said stencil supply unit and/or said stencil take-up unit, said fourth positioning means being positioned on one end surface of said rotary cylindrical drum so that said stencil supply unit and/or stencil take-up unit is or are integral with said rotary cylindrical drum;

third engaging means for selectively engaging with said third or fourth positioning means and included in said stencil supply unit; and fourth engaging means for selectively engaging with said third or fourth positioning means and included in said stencil take-up unit.

10. A stencil duplicating machine as in claim 9, wherein said stencil supply unit and said stencil take-up unit include positioning means for positioning themselves to be adjacent each other with respect to said drum while there is no stencil present on the surface of said drum.

11. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis independently of rotation of said stencil supply unit;

a stencil making section cooperating with the stencil for perforating patterns of an original image on the stencil; and engaging means for engaging the stencil supply unit and said stencil take-up unit with the rotary cylindrical drum and independently engaging only the stencil take-up unit with the rotary cylindrical drum.

12. A stencil duplicating machine as in claim 11, wherein said stencil supply unit and said stencil take-up unit include positioning means for positioning themselves to be adjacent each other with respect to said drum while there is no stencil present on the surface of said drum.

13. A stencil duplicating machine comprising a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil; and driving means for coupling said rotary cylindrical drum, said stencil supply unit and said stencil take-up unit such that said rotary cylindrical drum, said stencil supply unit and said stencil take-up unit rotate round said axis as an integral unit during a printing operation, and for temporarily connecting said rotary cylindrical drum and said stencil take-up unit such that said rotary cylindrical drum and said stencil take-up unit may rotate round said axis independent of said stencil supply unit at a time other than a printing operation.

14. The stencil duplicating machine of claim 13 wherein said stencil supply unit and said stencil take-up unit each include positioning means.

15. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil;

an immovable frame or member, wherein said stencil making section includes a platen roller for conveying the stencil thereon and stencil perforating means which is independent from said platen roller and is supported by said immovable frame or member, wherein said stencil perforating means comes into contact with said platen roller so as to perforate the original image pattern on the stencil passing over said platen roller; and engaging means for engaging the stencil supply unit and said stencil take-up unit with the rotary cylindrical drum and independently engaging only the stencil take-up unit with the rotary cylindrical drum.

16. A stencil duplicating machine as in claim 15, wherein said stencil supply unit and said stencil take-up unit include positioning means for positioning themselves to be adjacent each other with respect to said drum while there is no stencil present on the surface of said drum.

17. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis independently of rotation of said stencil supply unit;

a stencil making section cooperating with the stencil for perforating patterns of an original image on the stencil; and engaging means for engaging the stencil supply unit and said stencil take-up unit with the rotary cylindrical drum and independently engaging only the stencil supply unit with the rotary cylindrical drum.

18. A stencil duplicating machine comprising:

a rotary cylindrical drum including a cylinder having an apertured portion and a non-apertured portion, and being adapted to support a stencil on an outer circumferential surface thereof and to be rotatable round an axis thereof with the stencil wound thereon;

an ink supply disposed inside said rotary cylindrical drum for supplying ink to an inner circumferential surface of said rotary cylindrical drum;

a stencil supply unit for supplying the stencil to said rotary cylindrical drum, said stencil supply unit including stencil support means for supporting a stencil web thereon and means for rotating said stencil supply unit round said axis;

a stencil take-up unit for taking up the stencil, said stencil take-up unit including stencil take-up means for holding a leading portion of the stencil, peeling the stencil from said rotary cylindrical drum, carrying the stencil thereon, and means for rotating said stencil take-up unit round said axis;

a stencil making section cooperating with the stencil for perforating patterns of an original image on the stencil;

an immovable frame or member, wherein said stencil making section includes a platen roller for conveying the stencil thereon and stencil perforating means which is independent from said platen roller and is supported by said immovable frame or member, wherein said stencil perforating means comes into contact with said platen roller so as to perforate the original image pattern on the stencil passing over said platen roller; and engaging means for engaging the stencil supply unit and said stencil take-up unit with the rotary cylindrical drum and independently engaging only the stencil supply unit with the rotary cylindrical drum.

* * * * *

UNITED STATES PATENT AND TRADEMARK OFFICE

CERTIFICATE OF CORRECTION

PATENT NO. : 5,513,564

DATED : May 7, 1996

INVENTOR(S) : Mitsuo SATO

It is certified that error appears in the above-indentified patent and that said Letters Patent is hereby corrected as shown below:

In column 6, line 58, change "frist" to --first--.

In column 8, line 65, change "it" to --1t--.

In column 11, line 38, change "it" to --1t--.

Signed and Sealed this

Second Day of September, 1997

*Attest:*

*Attesting Officer*

BRUCE LEHMAN

*Commissioner of Patents and Trademarks*